United States Patent [19]

Ramsey

[11] 4,086,732

[45] May 2, 1978

[54] APPARATUS AND METHOD FOR REFINISHING THE END SURFACE OF A RAILROAD AXLE

[76] Inventor: William K. Ramsey, 5134 N. Lake Dr., Roanoke, Va. 24019

[21] Appl. No.: 608,104

[22] Filed: Aug. 27, 1975

[51] Int. Cl.[2] ..... B24B 19/00; B24B 1/00

[52] U.S. Cl. ..... 51/241 S; 51/289 R; 51/258

[58] Field of Search ..... 51/241 S, 241 VS, 241 B, 51/281 P, 289 R, 290, 241 R, 258

[56] References Cited

U.S. PATENT DOCUMENTS

| | | | |
|---|---|---|---|
| 1,748,343 | 2/1930 | Gustafsson | 51/241 B |
| 2,257,619 | 9/1941 | Prill | 51/241 B |
| 2,878,626 | 3/1959 | Elliott | 51/241 VS |

FOREIGN PATENT DOCUMENTS

| | | | |
|---|---|---|---|
| 467,259 | 10/1928 | Germany | 51/241 B |

*Primary Examiner*—Harold D. Whitehead
*Assistant Examiner*—James G. Smith
*Attorney, Agent, or Firm*—Lockwood, Dewey, Zickert & Alex

[57] ABSTRACT

A grinding apparatus for refinishing the end surface of a railroad locomotive axle without removal of the axle from its operative position in the locomotive which includes a frame having a mounting plate which is adapted to be detachably connected to the journal box that surrounds the axle end surface to be refinished, a shaft supported by said frame and concentrically aligned with the axle, and a powered grinding tool mounted to the shaft and rotatable about the axis thereof, the grinding tool includes a working surface which engages and abrasively refinishes the axle end surface.

26 Claims, 5 Drawing Figures

APPARATUS AND METHOD FOR REFINISHING THE END SURFACE OF A RAILROAD AXLE

BACKGROUND AND DESCRIPTION OF INVENTION

The present invention generally relates to shaft refinishing apparatus and methods and, more particularly, to an apparatus and method for refinishing the end surface of railroad locomotive axles. In this regard, an important embodiment of the present invention is specifically directed to an improved apparatus and method for in situ grinding or resurfacing the scored planar end surface of railroad locomotive axles of the type which are retained from lateral shifting by thrust blocks located in journal boxes at opposite ends thereof.

In modern diesel-electric locomotives, the wheels, typically carried in groups of six or eight, are mounted upon axles, the opposite ends of which are usually respectively positioned within a pair of axle journal boxes which contain bearing assemblies that provide relatively friction-free rotation of the axles. These locomotives commonly employ electric traction motors which are directly geared to the driving axles which in turn apply a tractive force to the rails. This tractive force is then transmitted through the axle journal boxes to the truck frame and through truck frame pressure areas to mating pressure areas on the truck bolster. The bolster then transmits the force through its center bearing to the car body center plate to move the locomotive and supply the locomotive drawbar horsepower.

Certain of these journal boxes, particularly those of the "New Departure-Hyatt" type, employ bearings which are separate from and rotatably fit over the axle within the journal box. This permits the axle to "float" somewhat within the bearing assembly with some degree of freedom in moving laterally during rolling operation in a direction parallel to the central axis of the axle, that is, transversely to the rails. This transverse movement of the axle necessitates some means of restraining and regulating the extent of such lateral movement which is commonly achieved, in part, through the employment of a thrust block within the journal box. These thrust blocks contact and restrain the planar, vertical ends of the axle during rotation of the axle and thus control and regulate the extent that the axle may laterally move during its rolling operation.

Control of such lateral movement, however, presents certain problems in maintaining the axle ends in a desirable operating condition. For example, foreign particulate matter such as dirt or dust of a gritty nature often will enter the journal box and then gravitate onto the surface of the thrust block and into abrasive contact with the rotating end surface of the axle. Thus, after a period of time, this abrasive action will score or abraid the end surface of the axle in an irregular fashion and greatly accelerate wear of the thrust block.

Since such scoring of the axle end surface is difficult to prevent, it becomes necessary to refinish the end surface of the axle by resurfacing the surface so as to eliminate the irregularities in such surface produced by the abrasive action of the foreign, gritty matter in contact with the thrust block. By present day techniques, however, such resurfacing of the axle end to its original smooth, planar surface normal to the central axis of the axle is an expensive and laborious operation since the axle must first be removed and placed in a suitable metal working machine such as a lathe so as to rework the end surface of the axle to the desired degree of smoothness necessary for effective operation. Removal of the axle from a diesel-electric locomotive is extremely cumbersome and involves the rather complex task of first separating the truck assembly from the heavy engine followed by removing the traction motor assembly and wheels therefrom, and then disassembling the same to free the axle from the bearings and other internal assemblies of the journal boxes. Such a complex operation involves considerable time to effect the desired refinishing of the axle surface and during such lengthy repair period the equipment undergoing repair is accordingly unavailable for service. This becomes rather costly in terms of equipment down-time particularly when expensive railway equipment such as locomotives are involved in the repair.

Further complicating the time consuming repair operation is the fact that the refinishing can only be conducted in a suitable railroad repair shop having equipment such as cranes as well as the extensive metal working machinery such as lathes having the size capacity and accuracy to rework the heavy and large railroad axles. This further serves to substantially increase the overall cost of this essential repair service because the railroad equipment to be repaired, for example, a locomotive, must be rerouted or taken from its remote service area after the repair which thus greatly increase the overall effective downtime for such valuable equipment.

The present invention overcomes the foregoing problems and disadvantages by providing a novel grinding apparatus and method for refinishing the end surface of a railroad locomotive axle without removal of the axle from its operative position in the locomotive. In a preferred embodiment, the apparatus of the present invention includes a frame which is adapted to be detachably connected to the journal box which surrounds the axle end surface to be refinished. The frame supports a central shaft to which a powered grinding tool is rotatably mounted. This grinding tool has a working face which engages and abrasively resurfaces the axle end surface. As such, the apparatus and method of the present invention enable the resurfacing operation to be effected in field or shop with a minimum down-time and at substantially reduced expense.

It is therefore an object of this invention to provide a grinding apparatus and method for resurfacing the scored end surface of a railroad axle of the type which, during operation, is restrained from lateral shifting by contact with a thrust block within a journal box.

Another object of this invention is to provide such grinding apparatus which may be employed to achieve such resurfacing without requiring removal of the axle from the locomotive.

Another object of this invention is to provide a locomotive axle end surface grinding apparatus which permits axle end surface refinishing to be effected without the necessity of extensive repair equipment and with minimal down-time of the railroad equipment being repaired.

Another object of this invention is to provide a locomotive axle end surface grinding apparatus and method which may be employed to achieve the resurfacing of the axle end in field if desired, thus avoiding the necessity of transferring the railroad equipment to a repair shop for such resurfacing.

These and other objects of this invention will be apparent from the following detailed description of a preferred embodiment thereof taken in conjunction with the accompanying drawings wherein.

Figure 1:
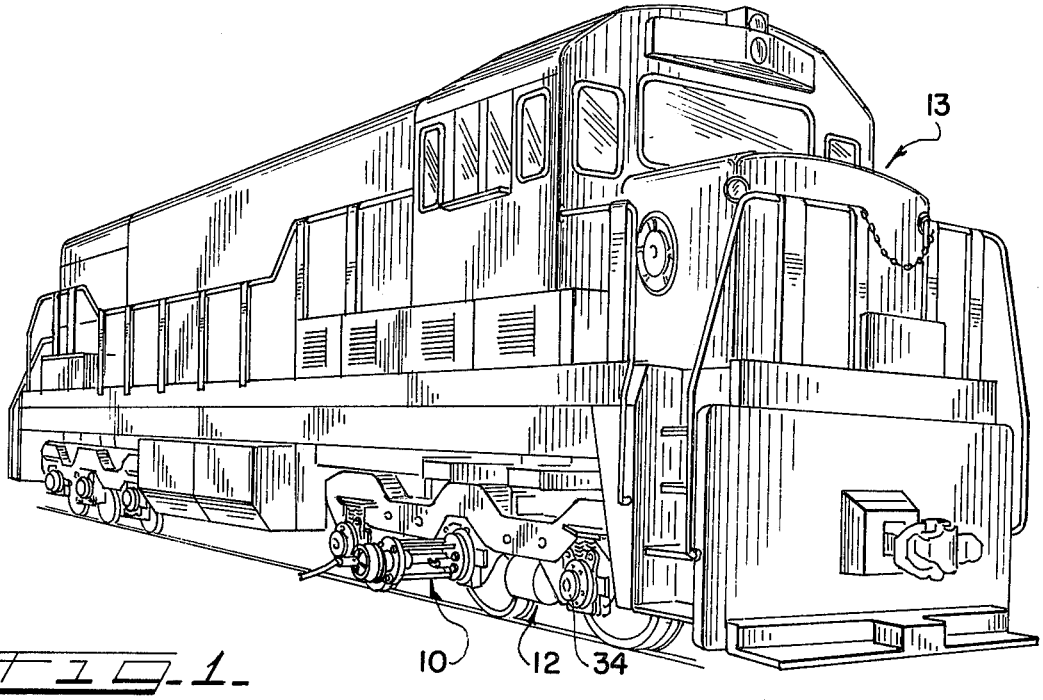
FIG. 1 is a perspective view of a railroad locomotive illustrating the grinding apparatus of this invention operationally connected to a journal box carried within a wheel truck assembly.
Figure 2:
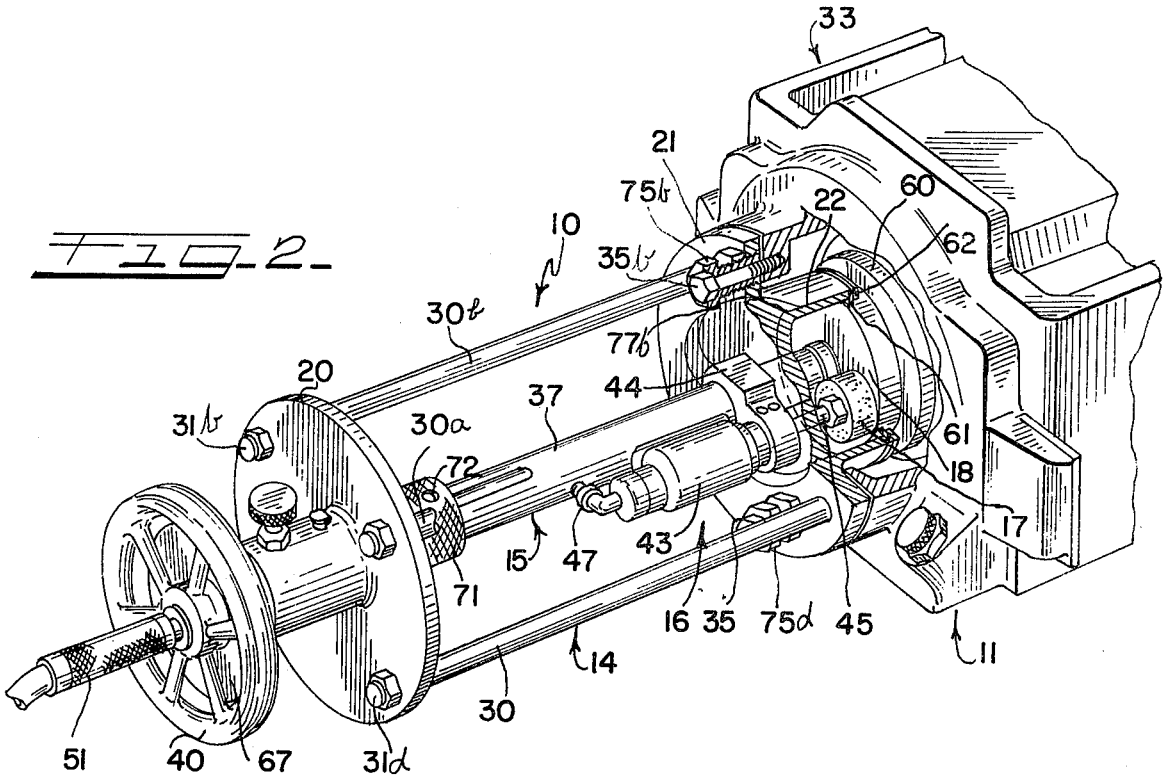
FIG. 2 is an enlarged perspective view of the grinding apparatus of FIG. 1 connected to the journal box, shown for clarity separate from the wheel truck assembly, with portions broken away illustrating this apparatus in the operation abrasively refinishing the end surface of a railroad axle.

Referring to FIGS. 1 and 2, a grinding apparatus embodying principles of the present invention is designated by the reference numeral 10 and shown in operative connection with a journal box 11 which is conventionally mounted to a wheel truck assembly 12 of a railroad locomotive 13. The grinding apparatus 10 in the illustrated embodiment includes a frame member 14 which, in accordance with an important aspect of the present invention, is detachably connectable to the journal box 11, more fully described hereinafter. Frame member 14 supportably surrounds a central shaft member 15 which, in turn, has a powered grinding tool 16 mounted thereon. The powered grinding tool 16 includes a grinding wheel 17 having a working face 17*a* which is engageable with the axle end surface 18 of the railroad axle 19 and which, in operation, abrasively refinishes that end surface upon complete rotation thereof about the central axis of the shaft member 15.

As shown in FIGS. 2–5, frame 14 includes opposed support plates 20 and 21 which, in the illustrated embodiment, are both of generally circular configuration. Support plate 21 preferably has an integral circular skirt section 22 extending from a flange portion 23 thereof while the support plate 20 has an inner collar section 24 preferably extending upwardly from an outer flange section 25. The support plates 20 and 21 are rigidly interconnected in a supportive unitary arrangement by a plurality of joining members or tie rods 30*a–d* extending therebetween. The tie rods 30*a–d* each have an upper threaded portion which passes through the support plate 20 which is respectively secured thereat by nuts 31*a–d*. Correspondingly, the lower portion of the tie rods 30*a–d* is threaded and thereby secured in locking arrangement in threaded bores 32*a–d* of support plate 21.

Figure 5:
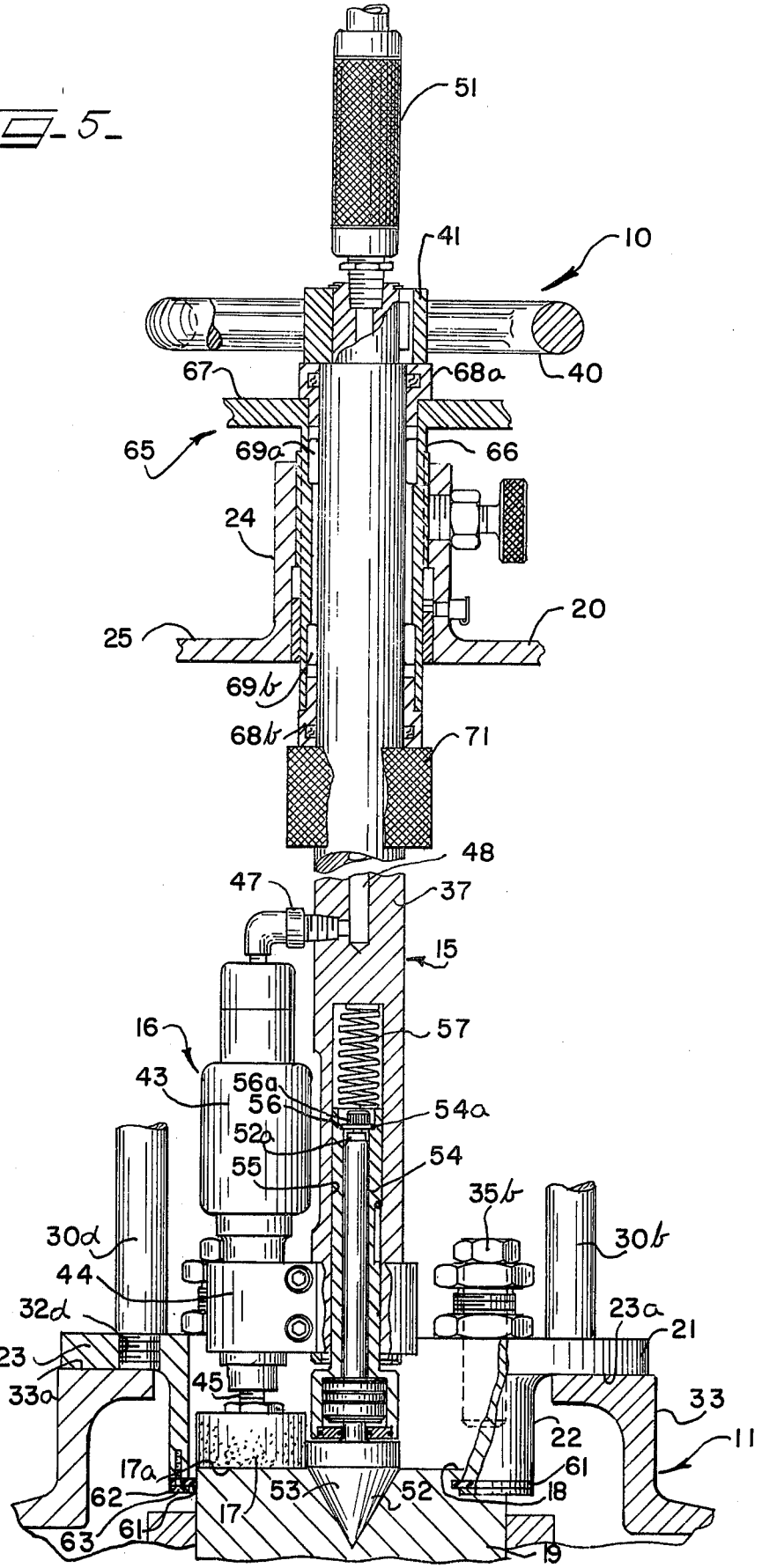
FIG. 5 is a view similar to that shown in FIG. 3 of the grinding apparatus mounted to a journal box, with certain portions shown in section and other portions partially broken away.

In accordance with an important aspect of the present invention, the grinding apparatus 10 is detachably connectable to the journal box 11 enabling the axle end refinishing operation to be conducted without removal of the axle from its operative position in the locomotive. As best shown in FIGS. 2 and 5, the front face 23*a* of flange 23 is sized to be mateably joined to the outside face 33*a* of the journal box housing 33. Removal of a front cover plate 34 on the journal box housing 33 (best shown in FIG. 1) provides access to the interior of the journal box 11, enabling removal of the thrust block (not shown) to expose the end surface 18 of the axle 19 and makes the threaded bores used to secure the journal box cover plate 34 available for use to secure the grinding apparatus 10. Suitable connecting members, for example, bolts 35*a–d*, extend through the flange section 23 of the support plate 21 at locations which are in registry with a like number of cover plate threaded bores of the journal box housing 33. Bolts 35*a–d* are inserted through the support plate 21 into the cover plate bolt threaded bores to thereby securely fix the grinding apparatus 10 to the journal box housing 33 during the axle refinishing operation.

Figure 3:
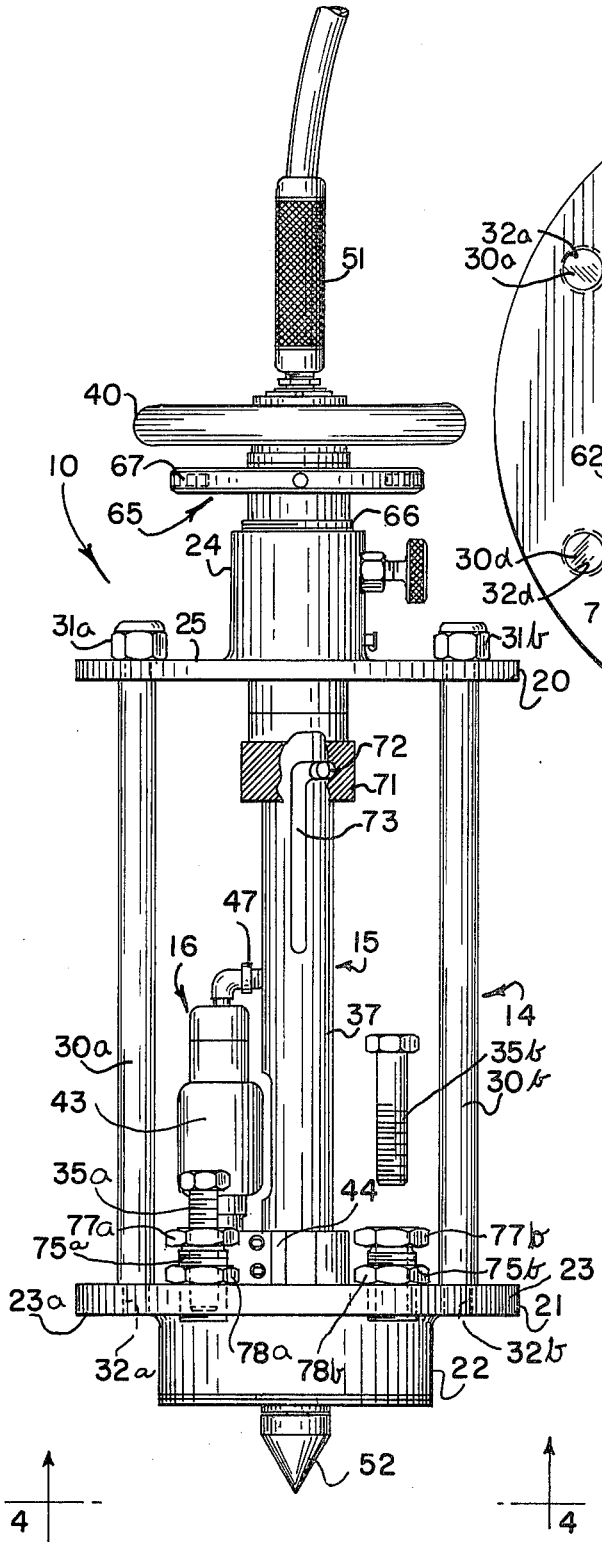
FIG. 3 is a top plan view of the grinding apparatus of this invention as illustrated in FIG. 1 but detached from the journal box.

In the illustrated embodiment, the shaft 15 is of generally tube-like configuration and is generally centrally located within the frame 14. As best shown in FIGS. 3 and 5, shaft 15 includes a column 37 which is rotatably mounted to frame 14 and extends through the collar section 24 of the support plate 20 thereof with its axis of rotation in generally concentric alignment with the central axis of frame 14 as well as the axis of rotation of the railroad axle 19 when the grinding apparatus 10 is in operative connection with the journal box 33 as shown in FIGS. 2 and 5. To facilitate rotation or turning of the column 37, a turning wheel or handle 40 fixed to end portion 41 thereof is provided.

Grinding tool 16 is mounted upon column 37 of shaft 15 and is shown to include a power driving means 43 which, in the illustrated embodiment, is an air motor 43 of conventional design. It will, of course, be appreciated that other suitable driving means such as, for example, an electric motor may be substituted for the air motor 43 which is preferred since it can be driven by a compressed air source in the locomotive itself, thereby enabling axle end refinishing to be done in the field, if necessary. Air motor 43 is mounted to column 37 by means of a bracket 44. The grinding wheel 17 is drivably connected to the air motor 43 by a drive shaft 45. As shown in FIGS. 2 and 5, grinding wheel 17 includes a working face 17*a* which, during axle end refinishing, is in abrasive engagement with the end surface 18 of the axle 19.

Air under elevated pressure sufficient to drive the air motor 43 is supplied via conduit 47 which extends radially outwardly from the column 37 and which further serves together with bracket 44 to fixedly support and lock the air motor 43 to the column 37. Conduit 47 is in fluid communication with an external air pressure supply source (not shown) through an internal conduit 48 in column 37 and valve 51 which serves to control the air pressure delivered to the air motor 43 and thereby regulate the speed thereof.

To facilitate the alignment of the central axis of the axle 19 with the central axis of the shaft 15, column 37 thereof, at its lower terminus, includes a centering head 52 which is shown to extend downwardly from the column 37 for engagement with a center hold 53 in the end surface 18 of the axle 19. Centering head 52 is rotatably received within a centering head bearing housing 54 which is housed within a recess 55 of the column 37. Centering head bearing housing 54 is fixed to the centering head 52 by means of plate 56 which fits against a shoulder 54*a* in the housing 54 and a locking screw 56*a* threadedly secured to the upper end 52*a* of centering head 52. A spring 57 held within the upper portion of the chamber 55 maintains a downward biasing force on the centering head 52 and facilitates proper alignment of the central axis of the column 37 with the central axis of the axle 19. In the illustrated embodiment, the centering head 52 is of the so-called live center type, i.e. it turns freely within the chamber 55.

Refinishing of the end surface 18 of the axle 19 is effected by abrasively engaging the working face 17*a* of grinding element 17 against the axle end surface 18 to provide that surface with a smooth planar configuration which is essentially normal to the central axis of the axle 19. The working face 17*a* of grinding wheel 17 contacts the end surface 18 in a plane normal to the central axis of the column 37 which, as previously indicated through appropriate alignment of the frame member 14, is also perpendicular or normal to the central axis of the axle 19. The column 37 is then rotated about its axis in a circular direction through 360°, such as by means of the handwheel 41, so that the working face 17*a* of grinding wheel 17 travels over the complete planar area of the end surface 18. In an illustrated embodiment, the working face 17*a* of grinding wheel 17 has a diameter substantially equal to the distance between the outside edge of the axle 19 and the rim of the center hole 53.

During the refinishing operation, a substantial amount of gritted particles are created by the abrasive action of the grinding wheel 17. It is, accordingly, important that these particles not contact the axle bearing assemblies (e.g. inner race 60 shown in FIG. 2) since these particles will cause severe deterioration and ultimate destruction of such bearing assemblies. To preclude passage of these particles into the axle bearings, and as a preferred feature of this invention, the downwardly extending skirt section 22 of support plate 21 is equipped with a seal ring 61 made of a resilient material and sized to snugly engage the outer surface of axle 19. As shown, seal ring 61 is mounted to the terminus of the skirt section 22 suitably by a retainer ring 62 which is secured to the end face 22*a* of skirt portion 22 by a plurality of screws 63. Seal ring 61, by reason of its resilient nature and size, stretches over and circumferentially around the axle 19 at a point inwardly from the end surface 18 of the axle 19. Thus, during grinding operation this seal forms a barrier and prevents any passage of abrasive particles into the axle bearing assembly of the journal box. As an associate feature, the air motor 43 can be equipped with an exhaust port which directs exhausted air from the motor into the journal box 11 to blow abrasive particles outwardly and away from the journal box 11.

In the illustrated embodiment, axial positioning of the grinding wheel 17 is provided by a feed adjusting means 65 which is best illustrated in FIGS. 2 and 5. As shown, feed adjusting means 65 includes an adjusting feed screw 66 of generally tubular configuration which is threadedly received in the collar section 24. A feed control portion 67 of wheel-like configuration is provided and is integral with and extends radially outwardly from adjusting feed screw 66. It will therefore be appreciated that feed control 67 will cause adjusting feed screw 66 to axially move forwardly or rearwardly with respect to the collar section 24. Accordingly, when the adjusting feed screw 66 is fixedly connected to the column 37, as hereinafter more fully explained, the column 37 may be axially moved with respect to the frame member 14 as desired by appropriate turning of the feed control 67. Such axial movement of the column 37, of course, axially moves the grinding wheel 17 with respect to the end surface 18 of the axle 19 to effect the desired positioning of the working face 17*a* of grinding wheel 17 on axle surface 18. As shown in FIG. 5, shaft 15 may also be provided with suitable bushings 68*a* and 68*b* and bearings 69*a* and 69*b*.

In accordance with one aspect of the present invention, the column 37 can be selectively disconnected from the feed adjusting screw 66, enabling it to slide freely and independently of the feed adjusting screw 66 to, for example, facilitate axial positioning of the grinding wheel 17 and centering head 52 when the tool 10 is first mounted to the journal box 33. Selective interconnection of the column 37 and feed adjusting screw 66 is achieved through the use of a locking collar 71 which is slidably mounted around the outer surface of column 37 and held in engagement thereon through the mating action of locking pin 72 fixed to the collar 71 and slidably received within a bayonet slot 73 formed in the column 37 causing the column 37 to be corotatably and coaxially fixed with feed adjusting screw 66.

Figure 4:
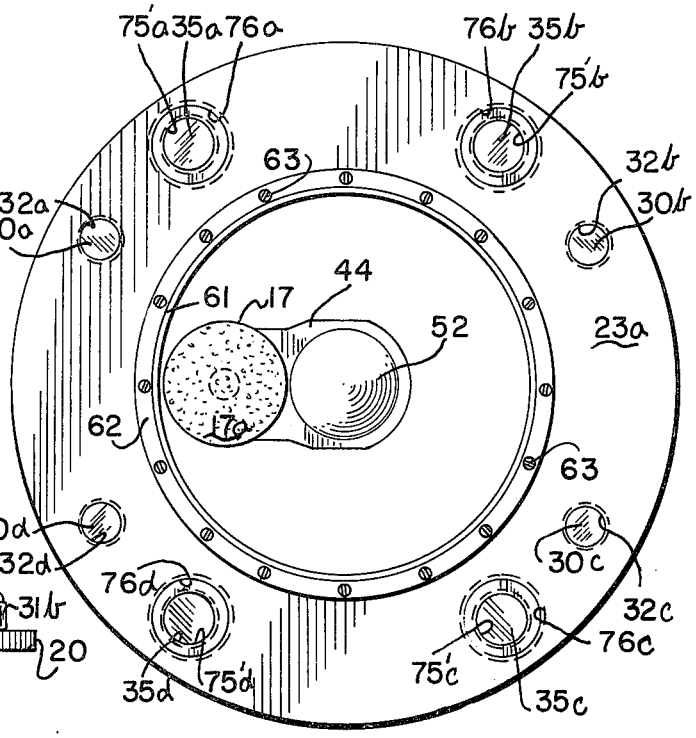
FIG. 4 is a front plan elevation of the grinding apparatus taken along the line 4—4 of FIG. 3.

In order to effect the desired refinishing of the end surface 18 of the axle 19, it is essential that the working surface 17*a* of grinding wheel 17, in rotating about the axis of column 37, travel in a plane which is perpendicular to the central axis of axle 19. Alignment means for achieving this result is provided by a plurality of adjustment screws 75*a–d* having respective internal bores 75′*a–d* through which mounting bolts 35*a–d* pass for threaded engagement with the threaded bores in the journal housing 33. As best shown in FIGS. 3–5, each of these adjusting screws 75*a–d* includes an externally threaded portion which is threadedly engaged in threaded bores 76*a–d*, respectively, formed in support plate 21. Penetration of the mounting bolts 35*a–d* is thus regulated by engagement of the heads of the mounting bolts with the shoulder portions 77*a–d* of the adjustment screws 75*a–d*. Correspondingly, the shoulder portions 77*a–d* are fixedly positioned at the desired axial spacing from support plate 21 by lock nuts 78*a–d*.

Operation of the grinding apparatus 10 in accordance with the method of this invention basically involves exposing the end surface 18 of the axle 19 without removing the axle from its journal box 11, connecting the grinding apparatus to the journal box 11, engaging the grinding element 17 into abrasive contact with the end surface 18 and thereafter effecting the abrasive grinding of the end surface 18 sufficiently to restore a substantially smooth, planar surface essentially normal to the central axis of the axle 19.

More specifically, the method involves first exposing the end surface 18 of the axle 19 by simply removing the journal box front cover 34 from the journal box housing 33 by unscrewing the cover plate bolts so as to free the front cover 34 from the housing 33. The thrust block assembly is then removed from the inside of the journal box 11 thus providing open access to the end surface 18 of the axle 19. The grinding apparatus 10 is then connected to the journal box housing 33 by orienting the apparatus 10 so as to mate the support plate 21 with the journal box housing 33 and align the respective bores 76*a–d* in registry with the corresponding cover bolt holes of the housing 33. As the lower base plate 21 is mated with the housing 33, the centering head 52 is guided into the center hole 53 of the axle 19. Also while guiding the centering head 52 into engagement with the center hole 53, the locking collar 71 may be disconnected from the locked position in bayonet slot 73 to permit the column 37 to move through the collar section 24 of the support plate 20. While the apparatus is being connected to the journal housing 33, the ring 61 projecting from the skirt section 22 of the support plate 21 is guided over the axle end so that as the connection is made the seal ring 61 slips along the axle and forms the desired dust barrier therearound. The bolts 35*a–d* are then extended through the adjusting screws 75*a–d* and bolted into the cover bolt holes so as to tightly connect the frame 14 with the journal box housing 33.

Prior to connecting the grinding apparatus 10, and in order to obtain the desired alignment of the central axis of the axle 19 with the axis of frame member 14, the adjusting screws 75*a–d* are appropriately adjusted to the desired height above the support plate 21 so that they will appropriately arrest the bolts 35*a–d* at the desired position which will assure proper alignment of plate 21 with the journal box housing 33. In this connection, prior to interconnecting the base plate 21 and the journal housing 33 it is generally recommended that those portions of the journal box housing 33 which mate with the plate 21 be suitably cleaned to remove any unevent surfaces or burrs from such surface which would adversely interfere with an appropriate mating and interconnection of such parts. Similarly, since the interior of the journal box during normal operation is extensively oiled and lubricated, it is usually desirable to clean the end surface 18 of the axle 19 to remove any residual oil or greases present on such surface.

In the event that the grinding wheel 17 has not been previously dressed, such dressing should be done at this time to assure that the grinding wheel will adequately achieve the desired refinishing.

After dressing the grinding wheel, if necessary, the grinding operation may be started. Accordingly, at this time the column 37 which had previously been slidably engageable within the collar section 24 is now locked securely with the adjusting feed screw 66 by twisting the locking collar 71 to bring such locking collar 71 firmly against the bushing 68*b*. The feed control wheel 67 is now turned to either move the working face 17*a* of grinding wheel 17 into contact with the end surface 18 of the axle 19.

Air under high pressure is then introduced to the air motor 43 via valve 51 and the internal bores which interconnect valve 51 with the air motor 43.

With the grinding wheel rotating at the desired rotational speed and in the desired abrasive contact with the end surface 18, the grinding operation is conducted and as the grinding proceeds the handwheel 41 is turned at an appropriate rate so that the grinding wheel 17 travels over the entire end surface 18. The handwheel 41 may be manually turned or, if desired, connected to an appropriate automatic drive (not shown) which turns the handwheel 41 at a preset rate or at a rate responsive to the grinding action.

During the grinding operation, the desired grinding contact between the working face 17*a* of grinding wheel 17 and the end surface 18 of the axle 19 may be adjusted by turning the feed adjusting wheel 67 to axially move the grinding wheel 17 and thus maintain the desired grinding pressure. Thus adjustment for the grinding pressure by actuating the feed control wheel 67 may be effected manually or, if desired, as in the instance of the handwheel 41, may be automated, for example, by interconnecting such feed adjusting wheel with an automatic drive means (not shown).

When the desired degree of grinding is complete, the air valve 51 is closed thereby stopping the rotation of grinding wheel 17 and the apparatus 10 thereafter is detached from the journal box 11. Removal is readily achieved and simply involves detaching the apparatus 10 from the journal box housing 33 by removing the bolts 35*a–d* to separate the lower base plate 21 from its contact with the housing 33. As the grinding apparatus 10 is pulled from the housing 33, the dust seal ring 66 positioned about the axle 19 serves to wipe such axle free of any gritty particles. Any remaining particles may be removed by air blowing and wiping the interior of the housing so as to insure that any such particles do not remain in the interior of the journal box housing 33.

After the grinding apparatus 10 is removed, the accuracy of the grinding may be verified and appropriately checked and the end surface 18 of the axle 19 thereafter sealed by reinserting the thrust blocks into the journal box 11 and applying the journal box cover 34 to close the journal box 11.

Refinishing of the end surface 18 achieved by the grinding apparatus 10 in accordance with the method of this invention, aside from permitting such refinishing to be effected remotely from a repair shop and without removing the axle from the journal box, also results in obtaining an end surface 18 which is effectively restored to its original smooth, planar surface essentially normal to the central axis of the axle 19.

It will be apparent to those skilled in this art that modifications and variations to the described embodiment may be made without departing from the spirit and scope of this invention. Accordingly, the present invention is to be construed and limited only by the scope of the appended claims.

I claim:

1. A grinding apparatus for the on site refinishing of a scored end surface of an axle in a bearing-axle assembly of the type wherein lateral shifting of the axle with respect to the bearing is restrained by the use of a thrust block contained in a journal box having a housing which includes an access opening which surrounds said axle end surface to be refinished, said axle end surface being generally perpendicular to the axis of said axle, said apparatus comprising: a frame; means for detachably connecting said frame to said journal box housing adjacent said access opening; support means mounted to said frame; and, a grinding tool mounted to said support means, said grinding tool including a working face which is generally perpendicular to the axis of said axle and which is engageable with said axle end surface for abrasively refinishing the same, said frame also including a skirt portion within which the working face of said grinding tool is located.

2. The grinding apparatus of claim 1 wherein said grinding tool comprises a grinding wheel which is rotatably driven by an air motor.

3. The grinding apparatus of claim 1 wherein said support means includes a shaft member having a centering head at one end thereof which is adapted to be received within a center hole in the end surface of said axle.

4. The grinding apparatus of claim 3 wherein said grinding tool is rotatable about the axis of said shaft member.

5. The grinding apparatus of claim 4 wherein said means for detachably connecting said frame to said journal box housing includes alignment means which enables axially concentric alignment of said shaft member with said axle, whereby rotation of said grinding tool about the axis of said shaft member with the working face thereof traveling only in a plane which is normal to the axis of said axle is achieved.

6. A grinding appratus and axle-bearing assembly of the type wherein the axle is axially restrained from lateral movement by a thrust block positioned within a journal box without the necessity of removing such axle from the journal box, said axle including an end surface generally perpendicular to the axis of said axle which becomes scored in use and which is to be refinished by said grinding apparatus, said apparatus comprising, a frame, means for detachably connecting said frame to the journal box, support means mounted to said frame, and a grinding tool mounted to said support means, said grinding tool including a working face generally perpendicular to the axis of said axle and engageable with the end surface of the axle to abrasively contact such end surface and thereby achieve the desired refinishing of said axle surface.

7. The apparatus of claim 6 wherein the support means comprises a shaft which is rotatably mounted to the frame member.

8. The apparatus of claim 6 wherein the frame includes adjusting means for aligning the central axis of the frame with the central axis of the axle so that the working face of the grinding tool will abrasively contact the end surface of the axle in a plane substantially normal to the central axis of the axle and thereby achieve the refinishing by reestablishing a substantially planar surface essentially normal to the central axis of the axle.

9. The apparatus of claim 6 wherein the frame includes feed adjusting means for regulating the engagement of the working face of the grinding tool with the axle end surface.

10. The apparatus of claim 6 wherein the support means comprises a shaft which includes an elongated column rotatably supported by the frame and centrally positioned within said frame, the central axis of said column being substantially co-extensive with the central axis of the frame.

11. The apparatus of claim 10 wherein the column of the shaft includes a centering face at one end thereof which is shaped for receipt into and within a center hole in the end surface of the axle to supportively align the central axis of the column with the central axis of the axle during the refinishing operation.

12. The apparatus of claim 6 wherein the grinding tool is mounted upon the shaft member and includes power means for driving the working face of the grinding tool in abrasive contact with the end surface of the axle to achieve the desired refinishing.

13. A grinding apparatus for refinishing the end surface of a railroad axle which has become scored while in restraining contact with a thrust block located within a journal box without the necessity of removing such axle from the journal box, said end surface being generally perpendicular to the axis of said axle, said apparatus comprising, in combination, a frame detachably connectable to the journal box, a shaft rotatably supported by the frame, said shaft including an elongated column generally centrally positioned within the frame with the central axis of the column being generally co-extensive with the central axis of the frame, said frame including adjusting means for substantially aligning the central axis of the frame with the axis of rotation of the axle, a grinding tool mounted upon the column of the shaft and including a grinding rool having a working face generally perpendicular to the axis of said axle and engageable with the end surface, said frame further including feed adjusting means for regulating the engagement of the grinding rool with the end surface, whereby as the column of the shaft is rotated about its axis the grinding tool, while in abrasive contact with the end surface, will circularly travel about the rotational axis of the shaft and over the entire planar end surface of the axle and thereby achieve the desired resurfacing of the axle end surface by re-establishing a substantially smooth planar surface which is essentially normal to the axis of rotation of the axle, said frame also including opposed first and second support plates rigidly interconnected to each other by tie rods extending therebetween, said first support plate including a flange portion which extends radially inwardly into a skirt portion which in turn is adapted to extend into the journal box in surrounding relationship to the end surface of the axle, said flange portion including connecting means for detachably connecting the frame to the journal box.

14. The apparatus of claim 13 wherein the column of the shaft includes a centering head at one end thereof which is adapted for receipt and engagement within a center hole in the end surface of the axle, said centering head thereby providing bearing alignment of the central axis of the column with the central axis of the axle during refinishing.

15. The apparatus of claim 13 wherein said grinding tool includes an air motor operatively connected to said grinding element for driving said grinding element when it is in abrasive contact with the axle end surface.

16. The apparatus of claim 13 wherein the connecting means include mounting bolts positioned through the flange portion in registry with bolt holes for the cover plate of the journal box.

17. The apparatus of claim 14 wherein the centering head is axially outwardly spring biased, whereby when said frame is connected to the journal box sufficient frictional force is created to assure a positive bearing engagement and bearing alignment of the centering head within the axle center hole.

18. The apparatus of claim 17 wherein the centering head is rotatably mounted within the column, whereby said column can be freely rotated while the centering head is maintained substantially stationary within the center hole of the axle end surface.

19. The apparatus of claim 16 wherein adjusting means are mounted to the first support plate which include at least one externally threaded screw member extending within and through a threaded opening in said first support plate at the same position that one of said mounting bolts passes therethrough for engagement with the journal box, said screw member having a hollow core and a shoulder portion at one end thereof, said shoulder portion being sized to engage with a head portion on said mounting bolt and to thereby limit further passage of said mounting bolt through said hollow core, whereby the spacial distance of said shoulder portion from said first support plate can be selectively adjusted by rotating said screw member within said threaded opening until the desired spacial distance between said shoulder portion from said support plate is achieved.

20. The apparatus of claim 13 wherein said feed adjusting means is operatively associated with said second support plate, said means including an adjusting feed screw threadedly mounted within a collar portion of said second support plate for axially moving said shaft with respect to said first and second support plates.

21. The apparatus of claim 20 wherein said column includes a locking collar slidably mounted on the column by means of a mating pin projection extending radially inwardly from said collar and into a bayonet slot in the column, whereby said locking collar upon upward and circumferential twisting rotation will pressure engage the adjusting feed screw and the column together and any axial movement of the adjusting feed screw will produce a corresponding movement of the column.

22. The appratus of claim 13 wherein the diameter of the skirt portion of the first support plate exceeds the diameter of the axle so that when the frame member is connected to the journal box the skirt portion will extend inwardly over the end surface of the axle, the terminus of such skirt section having a seal ring positioned thereon, such ring extending radially inwardly from such terminus and having an inside diameter less than the diameter of the axle so that as the frame member is connected the ring will stretch over and compression fit securely and circumferentially around the axle at a point inwardly from the end of the axle and thereby prevent any passage of abrasive particles created by the grinding inwardly beyond such point and into contact with the bearing assembly of the journal box.

23. The apparatus of claim 13 wherein the grinding element is a grinding wheel, the diameter of such wheel being substantially equal to the distance between the edge of the axle and the rim of the axle center hole, whereby as the column is rotated about its central axis with respect to the stationary frame the grinding wheel driven by driving means carried on the column will abrasively refinish the entire planar end surface of the axle.

24. The apparatus of claim 15 wherein an air conduit for supplying pressurized air to the air motor is provided within the column of the shaft and in fluid communication with an air valve for regulating the air flow to the air motor from an external pressurized air source.

25. The apparatus of claim 13 wherein said skirt portion includes sealing means engageable with the railroad axle.

26. A method for refinishing the end surface of a railroad axle abraided while in restraining contact with a thrust block within a journal box operatively associated therewith without the necessity of removing such axle from the journal box, comprising exposing the end surface of the axle maintained within the journal box by removing a cover plate thereof, mounting a grinding apparatus to the journal box, said grinding apparatus including a grinding element having a working face which is generally perpendicular to the axis of said axle, abrasively contacting said end surface with the working face of the grinding element in said apparatus to restore a substantially smooth, planar surface essentially normal to the central axis of the axle, removing said apparatus from the journal box, and thereafter replacing said cover plate on said journal box.

* * * * *

UNITED STATES PATENT AND TRADEMARK OFFICE

CERTIFICATE OF CORRECTION

PATENT NO. : 4,086,732

DATED : May 2, 1978

INVENTOR(S) : William K. Ramsey

It is certified that error appears in the above-identified patent and that said Letters Patent are hereby corrected as shown below:

Column 9, line 1, "appratus" should read --apparatus--

Column 9, line 65, "rool" should read --tool--

Column 10, line 1, "rool" should read --tool--

Column 11, line 9, "appratus" should read --apparatus--

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*